US009941082B2

(12) United States Patent
Solak

(10) Patent No.: US 9,941,082 B2
(45) Date of Patent: Apr. 10, 2018

(54) FLOAT SWITCH ASSEMBLY

(71) Applicant: David M. Solak, Seven Hills, OH (US)

(72) Inventor: David M. Solak, Seven Hills, OH (US)

(73) Assignee: David J. Solak, Seven Hills, OH (US)

( * ) Notice: Subject to any disclaimer, the term of this patent is extended or adjusted under 35 U.S.C. 154(b) by 159 days.

(21) Appl. No.: 14/950,339

(22) Filed: Nov. 24, 2015

(65) Prior Publication Data

US 2017/0148593 A1 May 25, 2017

(51) Int. Cl.
*H01H 35/18* (2006.01)
*H01H 36/00* (2006.01)
*G08B 21/18* (2006.01)

(52) U.S. Cl.
CPC ..... *H01H 35/18* (2013.01); *G08B 21/182* (2013.01); *H01H 36/0033* (2013.01)

(58) Field of Classification Search
CPC .. H01R 25/003; H01R 13/70; H01R 13/7038; H01R 13/665; H01H 35/186; H01H 29/20; Y10T 137/8342; Y10T 137/1866; Y10T 137/7287
USPC ..... 307/116, 147, 114; 340/618; 200/84 R, 200/61.2, 61.52, 84 B
See application file for complete search history.

(56) References Cited

U.S. PATENT DOCUMENTS 4,796,017 A 1/1989 Merenda
4,825,587 A 5/1989 Stancil
4,930,252 A 6/1990 Krause et al.
4,967,508 A 11/1990 Reynolds
5,318,267 A 6/1994 Rast
5,425,199 A 6/1995 Sofy
5,473,837 A 12/1995 Skoczylas et al.
5,590,865 A 1/1997 Odom, Jr.
5,791,083 A 8/1998 Giangrossi
5,867,929 A 2/1999 Jung et al.
5,937,574 A 8/1999 Jacques
5,969,620 A 10/1999 Okulov
7,147,014 B2 12/2006 Chien
7,471,206 B1 12/2008 Ellerman
7,484,703 B2 2/2009 Krinner
7,736,496 B2 6/2010 Degiacomo
7,765,736 B1 8/2010 Lloyd
8,132,360 B2 3/2012 Jin et al.
2007/0026728 A1* 2/2007 Mak ..... H01R 13/504 439/505
2008/0167868 A1* 7/2008 Kanevsky ..... G10L 15/20 704/233
2010/0313471 A1 12/2010 Middaugh
2012/0000535 A1* 1/2012 Poyner ..... A47L 15/0049 137/1

* cited by examiner

*Primary Examiner* — Ahmed Saeed
(74) *Attorney, Agent, or Firm* — Curatolo Sidoti Co., LPA; Salvatore A. Sidoti; Joseph G. Curatolo

(57) ABSTRACT

A float switch assembly for detecting fluid levels in a reservoir such as in a Christmas tree stand. When the fluid level drops below a predetermined point, the float switch activates an external circuit which provides a visual and/or audible signal. After the fluid level in the reservoir has been restored to the full position, the switch deactivates the external circuit and the visual and/or audible signal turns off. Also disclosed is a Christmas tree stand in combination with the float switch assembly.

15 Claims, 5 Drawing Sheets

FLOAT SWITCH ASSEMBLY

TECHNICAL FIELD

This disclosure relates to a float switch assembly for detecting fluid levels in a reservoir. This disclosure more particularly relates to a float switch assembly for detecting fluid levels in a Christmas tree stand.

BACKGROUND

A float switch is a device used to detect the level of liquid within a reservoir, container, or the like. Numerous types of float switches are known. They may be physically integrated with the devices they control, or physically independent and only electrically integrated with those devices.

Float switches are often used as safety devices. For instance, many times the water in a Christmas tree stand drops to low levels due to healthy propagation efforts by the tree. Since the tree has been cut of its roots, the tree can only live a short time after it is harvested. It is important to keep the water filled in the tree stand so that the tree branches and needles do not dry out, thereby preventing the tree from becoming a fire hazard.

In the past, a variety of methods have been proposed for adjustably positioning the float switch at a preselected position in order to maintain liquid levels within certain desired bounds. Typically, a portion of the float switch is secured at a certain vertical position of the reservoir with the use of hardware and requires a multiplicity of components and other tools for adjusting the switches. Unfortunately, such practices do not lend themselves to easy, quick installation and are generally unsatisfactory in one respect or another.

Therefore, it can be appreciated that there exists a continuing need for a new and improved float switch assembly that alerts someone when the fluid level in a fluid reservoir falls below a predetermined point.

DETAILED DESCRIPTION

Figure 1:
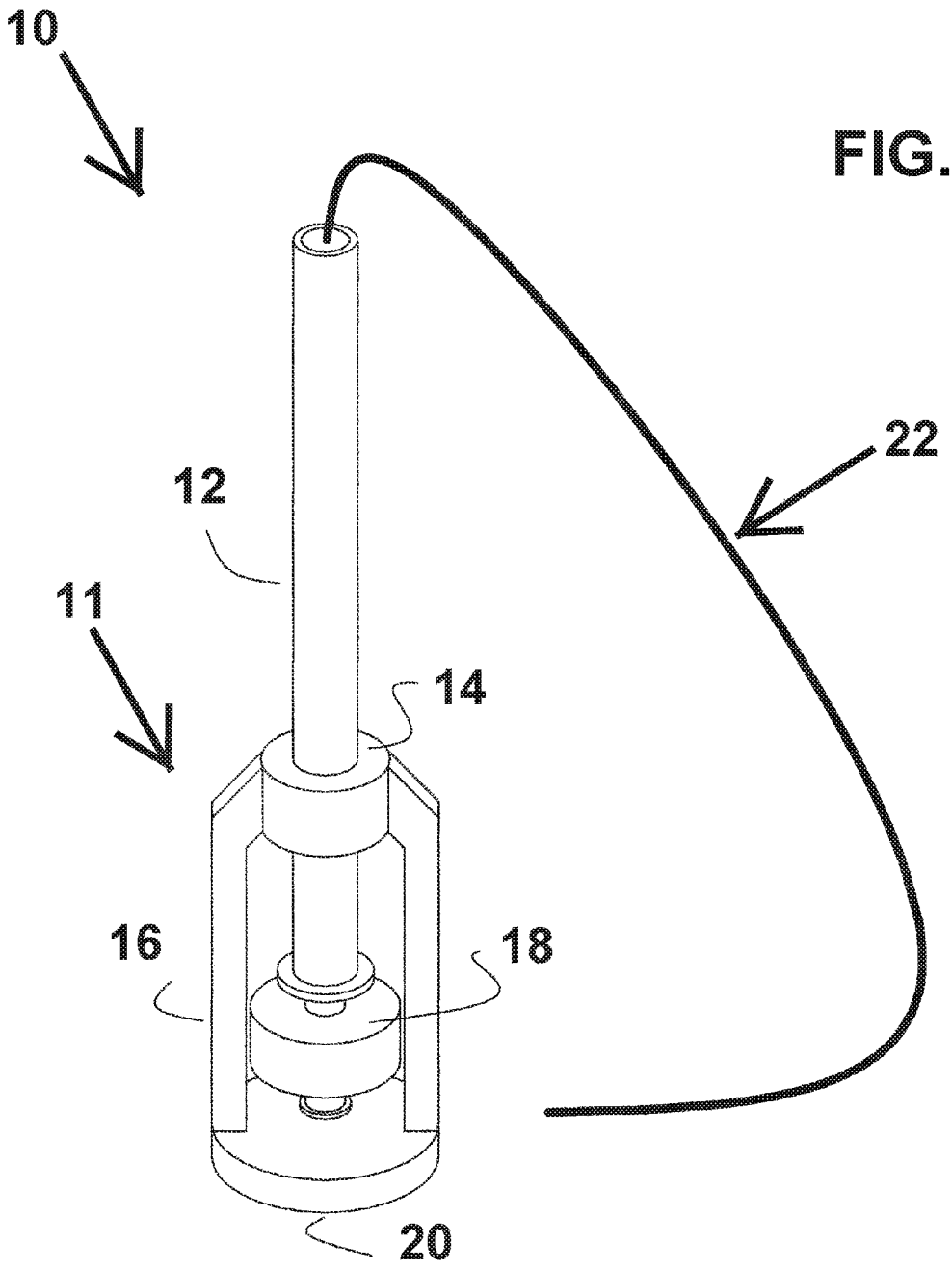
FIG. 1 is a front view of one illustrative embodiment of the float switch assembly showing the float switch positioned near the base member of the assembly.

According to certain embodiments, the float switch assembly comprises (i) a frame, (ii) a movable housing engaged with the frame, and (iii) a float switch engaged with the movable housing.

Also disclosed is a float switch assembly comprising (i) a frame, (ii) a movable housing engaged with the frame, (iii) a float switch engaged with the movable housing, (iv) an electrical circuit in electrical communication with the float switch, (v) a signal generator in electrical connection with the electrical circuit, and (v) a power source.

Also disclosed is a combination comprising (a) a Christmas tree stand, (b) a float switch assembly comprising a (i) a frame, (ii) a movable housing engaged with the frame, (iii) a float switch engaged with the movable housing, (iv) an electrical circuit in electrical communication with the float switch, (v) a signal generator in electrical connection with the electrical circuit, and (v) a power source.

The electrical circuit and the signal generator are contained or otherwise housed within a control box. When the fluid level in a reservoir, such as a Christmas tree stand, drops below a predetermined point, the float switch closes the electrical circuit inside the control box. Closing the electrical circuit activates the signal generator to produce a visual signal, an audible signal, or both a visual and audible signal to alert someone that the fluid level in the reservoir is too low and needs to be refilled. Once the fluid level in the reservoir is restored to the predetermined level, the float switch opens the electrical circuit and the signal generator is deactivated. Consequently, the visual and/or audible signal turns off.

The float switch assembly includes a frame. The frame defines a region where the float switch is positioned. The frame comprises (i) a collar that is located at or near its upper end, (ii) a base member that is located at or near its lower end, and (iii) at least two support arms connecting the collar to the base member. The geometric shape of the collar and base member of the frame are not limited. According to certain embodiments, the perimeter of the base member of the frame is greater than the perimeter of the collar. According to certain embodiments, the collar and the base member of the frame are substantially circular. According to the embodiments where the collar and base member of the frame are substantially circular, the outer circumference of the base member is greater than the outer circumference of the collar.

At least one of the support arms of the frame may include a scale comprising a plurality of gradations and sub-gradations, otherwise referred to as measuring lines, for accurately positioning the float switch to the desired position.

The components of the float switch assembly can be die-cast, sand-cast, injection molded in plastic, extruded, or fabricated by conventional welding techniques.

The components of the float switch assembly may be manufactured from polymers, metals, metal alloys, or composite materials. According to certain illustrative embodiments, the components of the float switch are manufactured from polymer materials.

In some embodiments, the base member of the frame is substantially flat. The base member is adapted to rest on the inner surface of the bottom wall of a fluid-containing reservoir, container, or the like. In some embodiments, the base member has at least one aperture that stabilizes the float switch assembly and prevents it from tipping over or from lifting up and off the bottom wall of the reservoir. In some embodiments, the base member is a circular base member having a substantially central aperture.

The movable housing of the float switch assembly may comprise an elongated hollow conduit having opposite first and second ends. The float switch is connected to the second end of the elongated hollow conduit. The elongated hollow conduit is engaged with the collar of the frame and is movable in the direction of the longitudinal axis of the elongated hollow conduit. According to certain embodiments, the elongated hollow conduit is in a friction fit engagement with the collar so that the elongated hollow conduit and the float switch can be maintained at the desired position during normal operation of the device. In other embodiments, the collar incorporates a tightening screw for further securing the elongated hollow conduit at the desired position.

The float switch and electrical wiring electrically connecting the float switch to the electric circuit in the control box are isolated from the liquid whose level is being sensed. This can be achieved by housing a fluid-proof plastic float sealed at both ends and a fluid-proof power cord emanating from one end, for electrical interconnection between the float switch and the electric circuit.

The density of the float switch is less than fluid, so that it will float at the surface of a body of fluid. The float is free to move up and down in response to changes in fluids levels in the reservoir.

In some embodiments, the float switch comprises at least one reed switch to sense changes in fluid levels and to close the electrical circuit to activate the signal generator. Reed switches are magnetically-operated switches, which are formed by a pair of spaced contacts. The contacts are connected to electrical leads, each lead is connected to at least one control box that houses an electric circuit. A suitable reed switch is commercially available from Omega, under the designation LV-80.

In certain embodiments, the reed switch is contained horizontally within a body portion of the switch and is surrounded by the float. The magnet is disposed to operate in a vertical plane relative to the reed switch and when the level drops to a certain level, the float similarly drops causing the magnet to activate the reed switch, which then activates the electric circuit that is in electrical communication with the reed switch.

In some embodiments, the float switch is attached to the second end of the elongated hollow conduit by tapping threads into the second end of the elongated hollow conduit. In other embodiments, the threads are molded in place on the interior surface of the second end of the elongated hollow conduit. In other embodiments, the float switch is bonded to the second end of the elongated hollow conduit with an adhesive.

In some embodiments, the float switch and movable housing (e.g., the elongated hollow conduit) components are integrally connected. For example, the housing component is integrally molded to the float switch. Alternatively, the float switch and housing components may be separate components that can be disconnected from each other.

The float switch assembly is capable of having differential adjustment means. Switch differential is the difference in fluid level between the point where the float switch is actuated versus the point at which the switch is not actuated. The elongated hollow conduit is movable in the direction of the longitudinal axis of the elongated hollow conduit. The on-off differential of the float switch is adjusted by moving the elongated hollow conduit to the desired position.

The float switch is electrically connected to the electric circuit by an elongated electrical connection, such as an electrically conductive wire or power cord. The electric circuit is housed within a control box. The control box includes an elongated electrical wire terminating in a plug. The plug is adapted to be inserted into an electrical outlet, such as a wall outlet, to provide a source of electrical power to the control box.

The control box may incorporate a 110-120 VAC outlet which permits lighting devices, such as a string of Christmas lights, to be plugged into the control box. The plug and electrical wire extend from the control box to connect to a power source, such as a source of direct current from a wall outlet. Alternatively, the power source for the control box may include a battery.

The electronic circuitry housed in the control box controls the activation of the signal generator to generate a visually perceptible signal and/or an audibly perceptible sound signal in response to a drop in fluid level in the reservoir being monitored.

In some embodiments, the control box includes a programmable sound making device comprising a memory that stores a plurality of audible segments and a speaker. The user of the device may record a personalized audible signal, message or alarm. The recorded signal, message, or alarm is stored in the memory of the device. When the fluid level in the reservoir being monitored drops below the predetermined level, the float switch closes the electric circuit and the signal generator generates the recorded signal, message, or alarm to alert someone that the fluid level must be refilled.

As will be readily understood by those skilled in the art, the float switch assembly provides a means for securely and rapidly positioning the operative position of the float switch so that the precise level of fluids within a reservoir, container, or the like can be adjusted with greater ease and without the use of separate components.

For the purposes of this description, the float switch assembly will be described in terms of its application to a Christmas tree stand, but it is to be understood that this is merely by way of example and in no way limits the float switch to such an application.

The float switch assembly can detect the fluid level in a Christmas tree stand at two stages, a full stage and an empty stage. At the full stage, the float switch is in the off position. At the empty stage, for example due to the tree absorbing fluid, the float drops causing the magnet to activate the reed switch, causing the electric circuit to activate the signal generator, housed within the control box, to emit at least one visual and/or audible signal. For example, the activated circuit may flash a string of Christmas lights that are plugged into the outlet on the control box.

When the float switch closes the electrical circuit, the circuit housed in the control box activates the visually and/or audibly perceptible signal. The visual and/or audible signal continues until the fluid level is restored to the predetermined full position and deactivates the signals.

In some embodiments, when the fluid level drops below a predetermined point, the float switch triggers a first relay in the electric circuit. Triggering the first relay activates a flasher unit. The activation of the flasher unit then triggers a second relay, resulting in the periodic opening and closing of the flasher outlet on the control box. This causes the lighting device plugged into the control box to turn off and on until the fluid level is restored to the predetermined full position.

In some embodiments, when the fluid level drops below a predetermined point, the float switch triggers a first relay in the electric circuit. Triggering the first relay activates a timing circuit contained in the electric circuit. The activation of the timing circuit triggers a third relay to periodically open and close at a set interval, which triggers a voice recorder to periodically turn on and off to play a recorded message.

In some embodiments, when the fluid level drops below a predetermined point, the float switch triggers a first relay in the electric circuit. Triggering the first relay activates the flasher unit and the timing circuit contained in the control box. The activation of the flasher unit then triggers a second relay to periodically open and close, resulting in the periodic opening and closing of the flasher outlet. The activated timing circuit triggers the third relay to periodically open and close at a set interval, which triggers the voice recorder to periodically turn on and off to play a recorded message.

The float switch assembly can be easily adjusted for use in a wide range of fluid reservoirs instead of having to change the design, structure and/or installation of the switch assembly for each different reservoir design.

The float switch assembly has means for adjusting the switch differential essentially externally of the float switch assembly and without necessitating disassembly of the float switch assembly. The float switch assembly need not be fixedly attached to the reservoir, as its design permits the assembly to be in a stable, upright free-standing position on the bottom of the reservoir.

The float switch assembly has a long and slender structure which allows the float switch assembly to be utilized in a wide range of fluid reservoirs, particularly reservoirs having narrow openings, such as Christmas tree stands.

The float switch assembly is readily understood when read in conjunction with illustrative FIGS. 1-5. It should be noted that the float switch assembly is not limited to any of the illustrative embodiments shown in the figures, but rather should be construed in breadth and scope in accordance with the disclosure provided herein.

FIG. 1 is a side view of one illustrative embodiment of float switch assembly 10 showing float switch 18 at a desired position. Float switch assembly 10 comprises at least two support arms 16 that are connected to a substantially cylindrical collar 14 at or near the upper end of frame 11 and a base member 20 at or near the lower end of frame 11. Elongated hollow conduit 12 has opposite first and second ends. Elongated hollow conduit 12 is slidably engaged with collar 14 of frame 11 of float switch assembly 10. Elongated hollow conduit 12 passes through collar 14 and extends into a lower region of frame 11. The outer circumference of elongated hollow conduit 12 is slightly smaller than the inner circumference of collar 14 to permit elongated hollow conduit 12 to be slidably engaged with collar 14 by a friction fit. The friction fit engagement allows float switch 18 to remain at the desired operating position. Float switch 18 is mounted to the second end of elongated hollow conduit 12 that extends through collar 14. Collar 14 allows movement of float switch 18 along the longitudinal axis of elongated hollow conduit 12 and lead electrical wires 22 maintained therein which electrically connect float switch 18 to control box (not shown).

Figure 2:
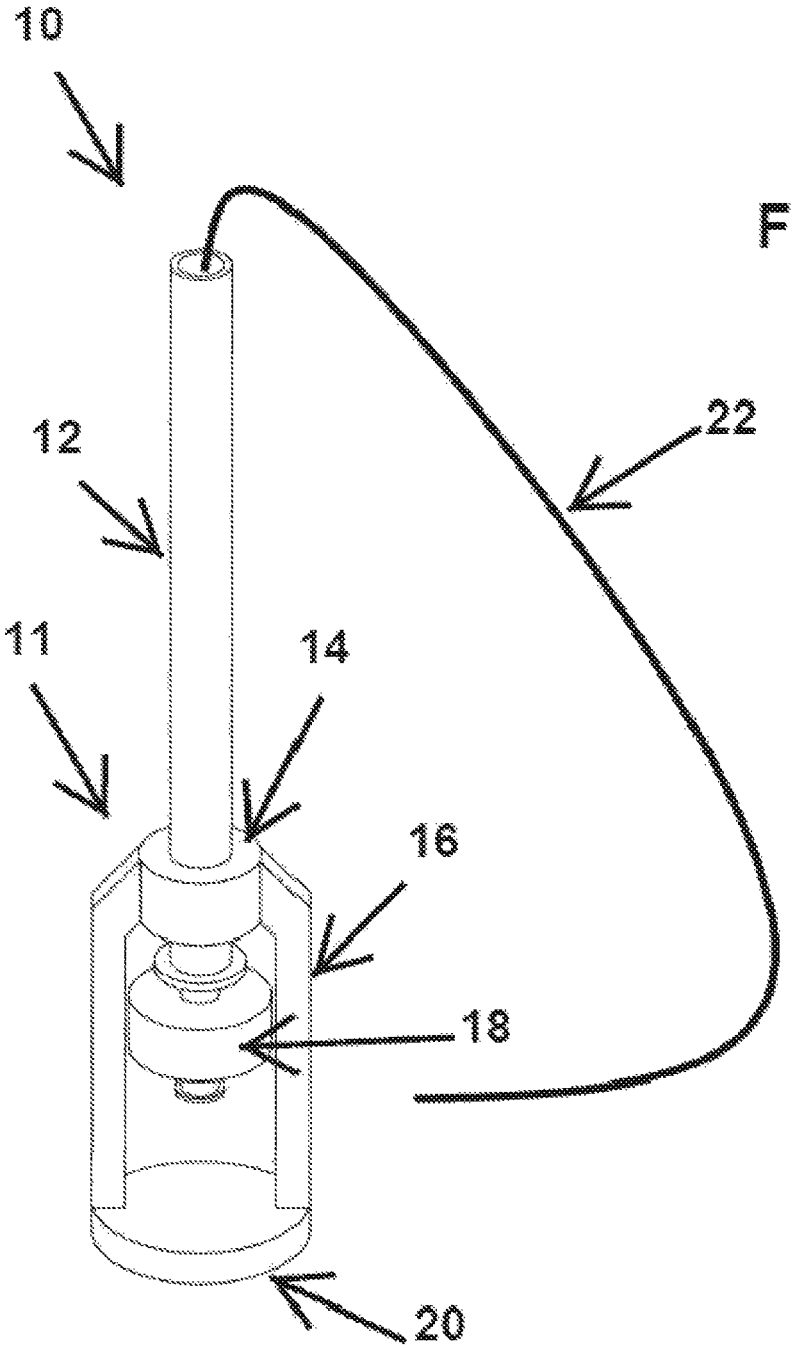
FIG. 2 is a front view of one illustrative embodiment of the float switch assembly showing the float switch positioned near the collar of the assembly.

FIG. 2 is a side view of one illustrative embodiment of float switch assembly 10 showing float switch 18 at a desired position that is different from the position shown in FIG. 1. Float switch assembly 10 comprises at least two support arms 16 that are connected to a substantially cylindrical collar 14 at or near the upper end of frame 11 and a base member 20 at or near the lower end of frame 11. Elongated hollow conduit 12 has opposite first and second ends. Elongated hollow conduit 12 is slidably engaged with collar 14 of frame 11 of float switch assembly 10. Elongated hollow conduit 12 passes through collar 14 and extends into a lower region of frame 11. The outer circumference of elongated hollow conduit 12 is slightly smaller than the inner circumference of collar 14 to permit elongated hollow conduit 12 to be slidably engaged with collar 14 by a friction fit. The friction fit engagement allows float switch 18 to remain at the desired operating position. Float switch 18 is mounted to the second end of elongated hollow conduit 12 that extends through collar 14. Collar 14 allows movement of float switch 18 along the longitudinal axis of elongated hollow conduit 12 and lead electrical wires 22 maintained therein which electrically connect float switch 18 to control box (not shown).

Figure 3:
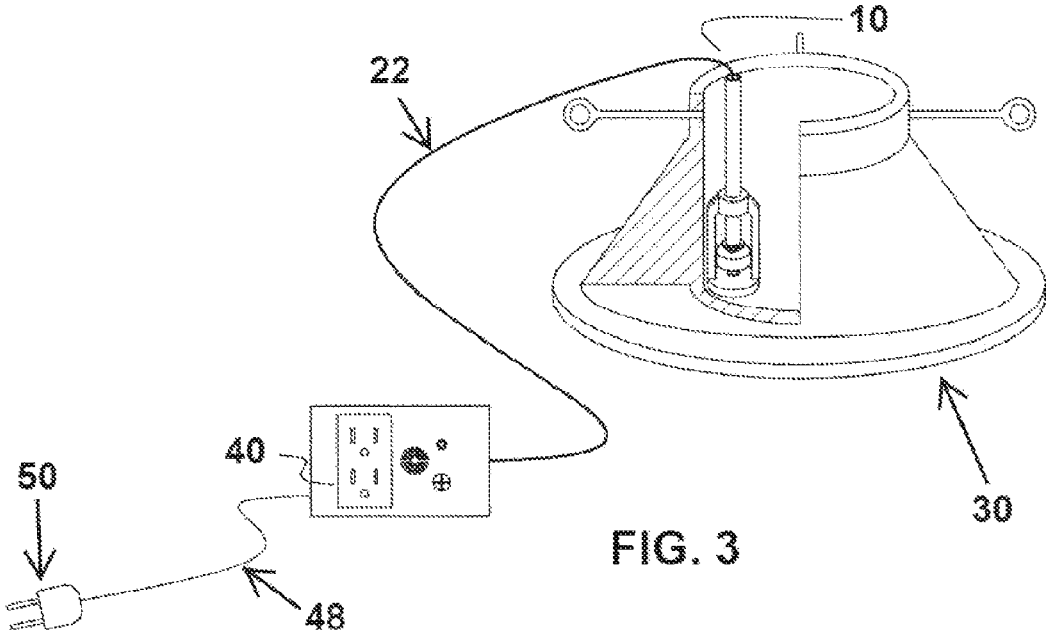
FIG. 3 is a cutaway perspective view showing the float switch assembly positioned within a Christmas tree stand in electrical connection with a control box.

FIG. 3 shows float switch assembly 10 positioned inside a Christmas tree stand 30. Float switch assembly 10 is electrically connected to a control box 40 by an elongated electrical connection 22, such as an electrically conductive wire or power cord. Control box 40 includes an elongated electrical connection 48 terminating in plug 50. Plug 50 is adapted to be inserted into an electrical outlet (not shown), such as a wall outlet, to provide a source of electrical power to control box 40.

Figure 4:
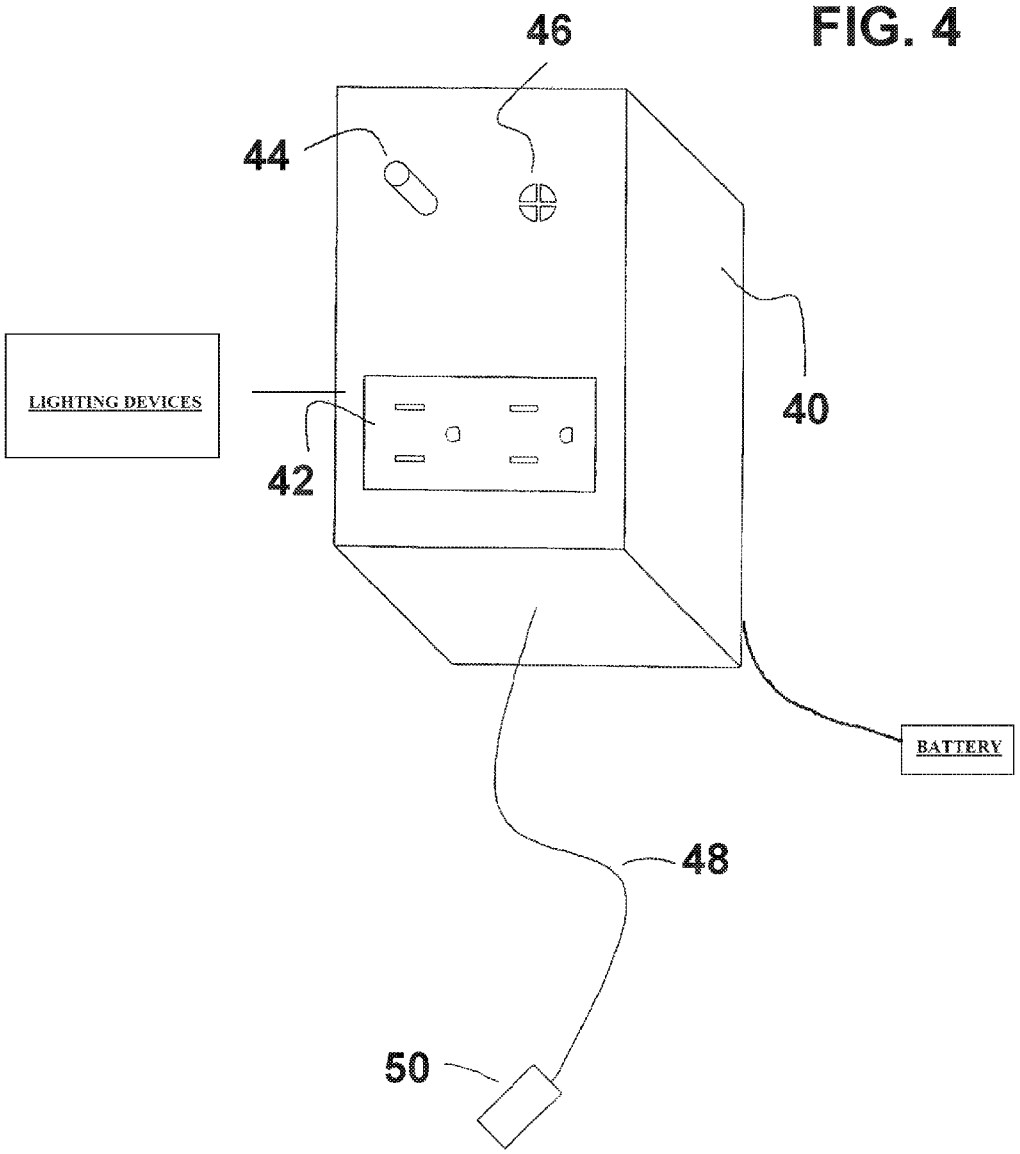
FIG. 4 is a front longitudinal view of one illustrative embodiment of the control box that houses an electric circuit.

FIG. 4 is a front view of one illustrative embodiment of control box 40. Control box 40 comprises pushbutton 44 which allows a message to be recorded through microphone 46 by activating voice recorder (not shown). Control box 40 further comprises a 110-120 VAC outlet 42 which permits lighting devices, such as a string of Christmas lights, to be plugged in. Plug 50 and elongated electrical connection 48 extend from control box 40 to connect to a power source (not shown), such as a source of direct current from a wall outlet.

Figure 5:
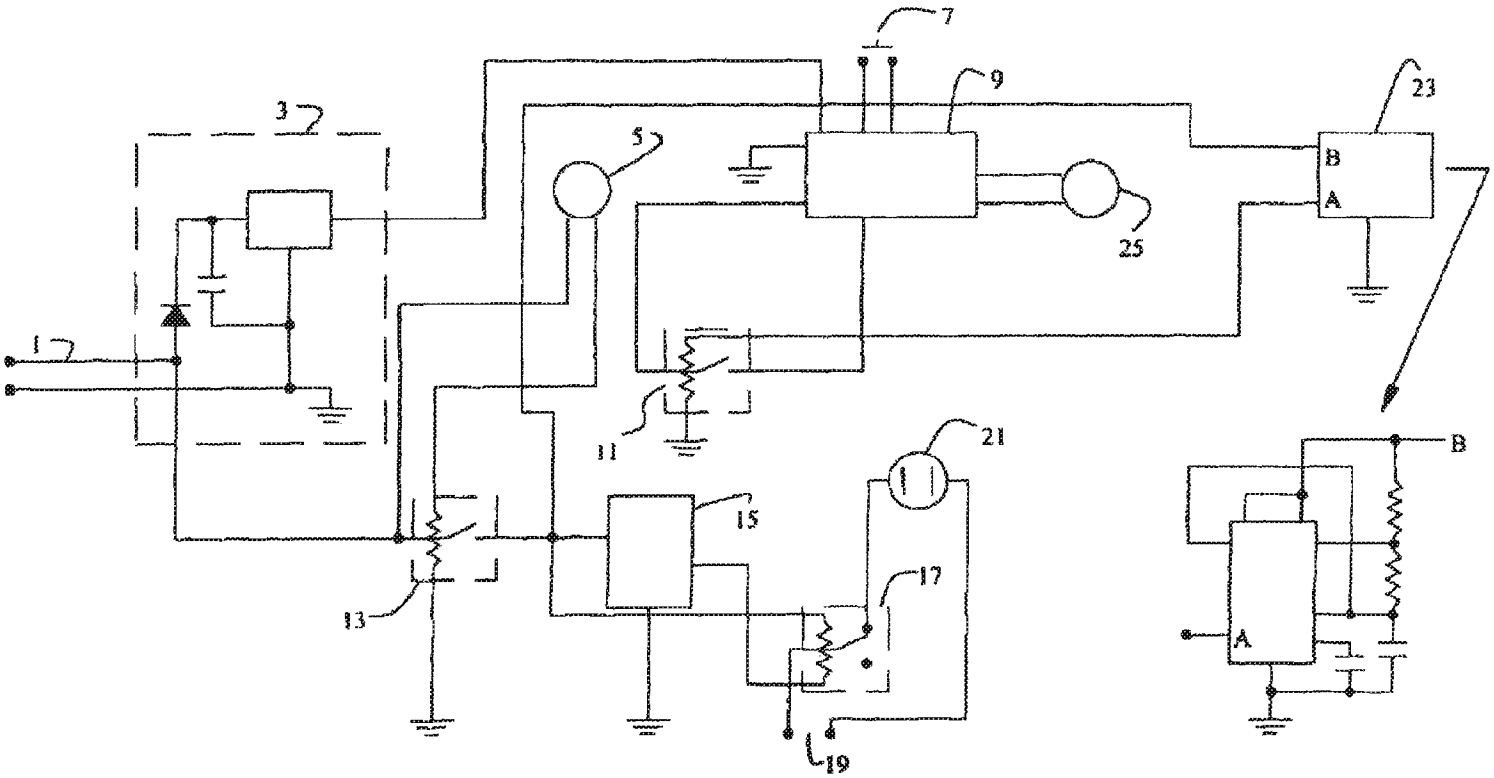
FIG. 5 is one illustrative embodiment of the electric circuit, shown in block diagram form, that is housed in the control box shown in FIG. 4.

FIG. 5 is one illustrative embodiment of the circuit, shown in block diagram form, that is housed in the control box 40 shown in FIG. 4. A power supply (not shown) with voltage regulator circuit 3 provides current to the entire electrical circuit. Regulator circuit 3 provides power to voice recorder 9. Flashing unit 15 will begin to open and close relay 17 when the float switch (not shown, see reference numeral 18 in FIG. 1) closes relay 13 due to low fluid level in the reservoir (not shown, see reference numeral 30 in FIG. 2). Relay 17 repetitively opens and closes a hot power lead 19 connected to an outlet 21. Float switch also triggers timing circuit 23 through electrical circuit B. Timing circuit 23 opens and closes relay 11 at a set interval provided by the timing circuit 23 through electrical circuit A. Relay 11 turns voice recorder 9 on and off at an interval. Pushbutton (not shown, see reference numeral 44 in FIG. 3) allows a message to be recorded on voice recorder 9 through a microphone (not shown, see reference numeral 46 in FIG. 3).

While the float switch assembly, and methods of using the float switch assembly have been described in connection with various embodiments, it is to be understood that other similar embodiments may be used or modifications and additions may be made to the described embodiments for performing the same function. Furthermore, the various illustrative embodiments may be combined to produce the desired results. Therefore, the float switch assembly, and methods of using the float switch assembly should not be limited to any single embodiment.

It will be understood that the embodiments described herein are merely exemplary, and that one skilled in the art may make variations and modifications without departing from the spirit and scope of the invention. All such variations and modifications are intended to be included within the scope of the invention as described hereinabove. Further, all embodiments disclosed are not necessarily in the alternative, as various embodiments of the invention may be combined to provide the desired result.

The invention claimed is:

1. An assembly comprising:

a frame, comprising (i) a collar at or near an upper end of said frame, (ii) a base member located at or near a lower end of said frame, and (iii) support arms connecting said collar to said base member, wherein said base member comprises a perimeter, wherein the perimeter of said base member is greater than a perimeter of said collar;

a movable housing engaged with said frame, said movable housing comprising an elongated hollow conduit having opposite first and second ends, and wherein said elongated hollow conduit passes through said collar and is slidably engaged with said collar of said frame; and wherein said elongated hollow conduit is in a friction fit engagement with said collar of said frame; and a float switch connected to said second end of said elongated hollow conduit.

2. The assembly of claim 1, wherein said collar comprises a tightening screw to further secure said elongated hollow conduit at a desired position.

3. The assembly of claim 1, wherein said float switch comprises a reed switch.

4. The assembly of claim 1, wherein at least one of said support arms is graduated to set the float switch at a desired position.

5. The assembly of claim 1, wherein said base member of said frame comprises at least one aperture.

6. The assembly of claim 1, comprising a control box housing an electric control circuit in electrical communication with said float switch.

7. The assembly of claim 6, wherein said control box comprises electrical wiring terminating in a plug adapted to be connected to a source of electrical power.

8. The assembly of claim 7, wherein the power source is in electrical communication with said electric control circuit.

9. The assembly of claim 8, wherein said power source for said electric control box comprises a battery.

10. The assembly of claim 7, wherein said control box includes an electric outlet adapted to permit a lighting device to be plugged into said outlet and wherein said outlet is in electric communication with said power source and said electric circuit.

11. The assembly of claim 10, wherein said lighting device comprises a string of Christmas lights.

12. The assembly of claim 6, wherein said control box further comprises an audible recorder activated by a push-button.

13. The assembly of claim 6, wherein said control box comprises a visual signal generator, an audio signal generator or both a visual signal generator and an audio signal generator, activated by said float switch.

14. An assembly comprising:

a float switch assembly comprising a frame, said frame comprising (i) a collar at or near an upper end of said frame, (ii) a base member located at or near a lower end of said frame, and (iii) support arms connecting said collar to said base member, wherein said base member comprises a perimeter, wherein the perimeter of said base member is greater than a perimeter of said collar;

a movable housing engaged with said frame, said movable housing comprising an elongated hollow conduit having opposite first and second ends, and wherein said elongated hollow conduit passes through said collar and is slidably engaged with said collar of said frame; and wherein said elongated hollow conduit is in a friction fit engagement with said collar of said frame; and a float switch connected to said second end of said elongated hollow conduit;

a control box in electrical communication with said float switch; and a power source.

15. A combination comprising:

a Christmas tree stand; and a float switch assembly comprising a frame, said frame comprising (i) a collar at or near an upper end of said frame, (ii) a base member located at or near a lower end of said frame, and (iii) support arms connecting said collar to said base member, wherein said base member comprises a perimeter, wherein the perimeter of said base member is greater than a perimeter of said collar;

a movable housing engaged with said frame, said movable housing comprising an elongated hollow conduit having opposite first and second ends, and wherein said elongated hollow conduit passes through said collar and is slidably engaged with said collar of said frame; and wherein said elongated hollow conduit is in a friction fit engagement with said collar of said frame; and a float switch connected to said second end of said elongated hollow conduit.

* * * * *